United States Patent [19]

Tada et al.

[11] Patent Number: 4,599,080

[45] Date of Patent: Jul. 8, 1986

[54] METHOD FOR FOLDING JACKET MATERIAL FOR DISK OR THE LIKE

[75] Inventors: Akira Tada, Toyonaka; Koichi Tanigawa, Kawanishi, both of Japan

[73] Assignee: O-M Limited, Osaka, Japan

[21] Appl. No.: 694,636

[22] Filed: Jan. 24, 1985

Related U.S. Application Data

[62] Division of Ser. No. 552,242, Nov. 16, 1983, Pat. No. 4,559,030.

[30] Foreign Application Priority Data

Nov. 19, 1982 [JP] Japan ..... 57-204347

[51] Int. Cl.[4] ..... B31B 1/28

[52] U.S. Cl. ..... 493/267

[58] Field of Search ..... 72/319, 320, 321, 322, 72/388; 493/243, 251, 252, 254, 267

[56] References Cited

U.S. PATENT DOCUMENTS

| | | | |
|---|---|---|---|
| 3,530,538 | 9/1970 | Quackenbush | 493/267 |
| 4,085,608 | 4/1978 | Franks et al. | 72/297 |
| 4,383,430 | 5/1983 | Klaus | 72/319 X |

FOREIGN PATENT DOCUMENTS

| | | | |
|---|---|---|---|
| 21561 | 7/1961 | German Democratic Rep. | 493/252 |

*Primary Examiner*—E. Michael Combs

*Attorney, Agent, or Firm*—Wenderoth, Lind & Ponack

[57] ABSTRACT

A method for folding a jacket material mainly for a magnetic cartridge, by using a folding insert, a folding bar and a heater bar, into a jacket of good external shape and high dimensional precision with a folded edge entirely free from loosening, warping, waving, swelling, etc.

2 Claims, 6 Drawing Figures

METHOD FOR FOLDING JACKET MATERIAL FOR DISK OR THE LIKE

This application is a divisional of application Ser. No. 552,242, filed Nov. 16, 1983, and now U.S. Pat. No. 4,559,030.

BACKGROUND OF THE INVENTION

1. Field of the Invention

This invention relates to a method for folding an envelope-shape jacket material for a magnetic cartridge.

2. Description of the Prior Art

In recent years, a magnetic cartridge with a magnetic disk on which voice signals, video signals, data signals, etc. are recorded and which is enclosed in an envelope-shape jacket has been used practically. The magnetic cartridge of this type is inserted into a floppy disk device of a computer as the magnetic disk therefor, while enclosed in a jacket and the recorded signal is reproduced by rotating the magnetic disk and by making a reproduction head follow the track thereon.

In the conventional method of folding jacket material, a forward end of a folding bar is positioned at the end surface of a table and the folding bar is simply moved in an arc and therefore loosening, warping, waving, swelling, etc. are liable to take place at the folded edge and as a heater bar is applied to such folded edge so that, formation of the folded edge is inaccurate, with the result of poor external shape and poor dimensional precision of the jacket.

SUMMARY OF THE INVENTION

An object of the present invention is to provide a method for folding a jacket material into a jacket for a magnetic disk which is entirely free from loosening, warping, waying, swelling, etc. at its folded edge and has good external shape and high dimensional precision.

IN THE DRAWINGS

DESCRIPTION OF THE PREFERRED EMBODIMENT

Figure 1:
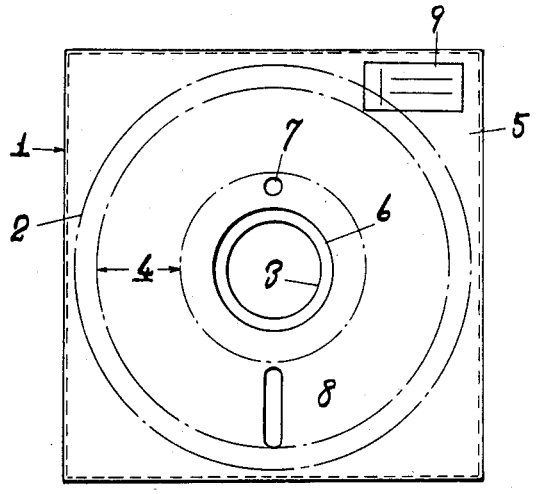
FIG. 1 is a front view of the magnetic cartridge.

In FIG. 1, a magnetic cartridge 1 comprises a magnetic disk 2 and a jacket 5 in which the magnetic disk is enclosed. The magnetic disk 2 is made of film having moderate flexibility, such as polyester resin. It has an engaging hole 3 at the center thereof and a track 4 coated with a magnetic layer on both surfaces thereof for recording or storing various signals thereon. The jacket 5 is made of thermosetting resin, such as vinyl chloride, and is shaped as a substantially square envelope. A circular opening 6 slightly larger than the engaging hole 3 is bored at the central part of the jacket 5. A detecting hole 7 for indicating the point of reproduction start and a slot 8 through which a reproduction head makes contact with the disk are made on diametrically opposite sides of of the circular opening 6. A ruled paper label 9 is stuck to the upper corner of the jacket.

Figure 2:
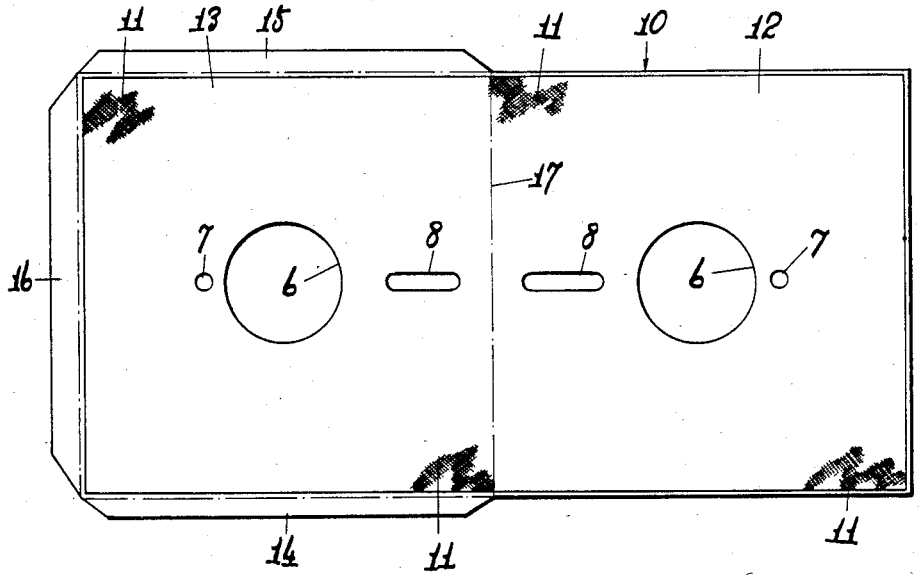
FIG. 2 is a front view of the jacket material.

As shown in FIG. 2, the jacket 5 is made of a rectangular sheet of material 10 which is folded in two. This jacket material 10 is covered with a nonwoven liner 11 over almost all the surface of its one side which becomes the inside of the jacket. The circular opening 6, the detecting hole 7 and the slot 8 are made at the designated positions on the right half portion 12 and the left half portion 13. Flaps 14, 15 and 16 of small width are provided at the three sides of the left half portion 13. This jacket material 10 is fed into a jacket forming device, where it is folded in two at its center line 17 and the folded edge is formed in a ⊐ shape by heating. Then, the flaps 14 and 15 at both sides are heat sealed over the corresponding edges of right half portion 12 to form an envelope-like jacket having the specified thickness dimension of the interior thereof into which the magnetic disk is inserted past the flap 16 and finally the flap 16 is heat sealed to the corresponding edge of the right half portion 12. It is possible to punch the circular opening 6, the detecting hole 7 and the slot 8 after the jacket 5 is made up.

Since this magnetic cartridge is inserted into a floppy disk drive of a computer with the magnetic disk 2 enclosed in the jacket 5, it has such advantages that the magnetic layer of the magnetic disk does not have dust stuck to it and is kept clean by the liner 11 while the magnetic disk is turning. However, high precision is required for the external form and dimensions of the jacket.

The method of the present invention relates to a process of folding a jacket material which constitutes the first stage of such jacket forming process. The method according to the present invention is characterized in that a forward end of a folding insert is caused to project from a front edge of the table of the jacket forming device and a jacket material is folded substantially 180° at its central part along the folding insert, as it is being rubbed by a folding bar. A heater bar is applied to the folded corner, before the folding angle of the jacket material becomes 180°, to form the folded corner into a ⊐ shape. By rubbing the jacket material with the folding bar, loosening, warping, waving, swelling, etc. at the folded edge are eliminated. By rubbing the jacket material by the folding bar while heating it by applying a heater bar to it earlier, the folded edge is formed into the ⊐ shape accurately. Thus, jackets having high precision of external form and dimensions can be produced with high efficiency. The present invention also provides an apparatus which is most suitable for carrying out such method of folding jacket materials.

An embodiment of the method according to the present invention is described below, with reference to FIG. 3.

Figure 3:
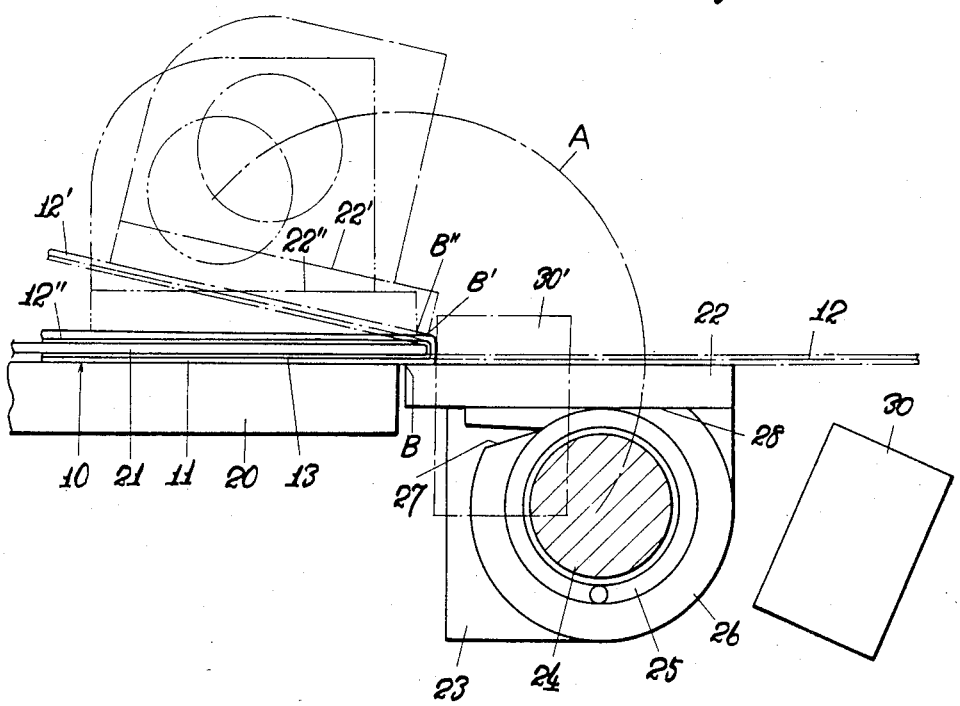
FIG. 3 illustrates the operation of one embodiment of the method according to the present invention.

In FIG. 3, numeral 20 designates a table of jacket forming device. A folding insert 21 with its left end fitted to a rocking arm (not shown in the drawings) is provided, facing the upper surface of the table 20. This folding insert swings up and down at a small angle at the designated times. In this embodiment, a forward end of the folding insert 21 is protruded slightly from a front edge (right side edge) of the table 20. Numeral 22 is a folding bar, with three bosses 23 (at both ends and at the central part) loosely fitted on a pivot 24. This pivot is moved about 180° counterclockwise and upwardly along an arcuate locus A. A spring 25 is wound round the pivot 24 and collars 26 are fixed on both ends of the spring. One end of the spring is inserted in one of the collars and the other end of it is applied to the undersurface of the folding bar 22 so that the folding bar 22 is subjected to a counterclockwise force by the elastic force of the spring 25. Each collar 26 is cut off to the right and the left of its upper center position to form slanting surfaces 27, 28 so that the folding bar 22 is allowed to move slightly relative to the spring 25 by the left slanting surface 27 and is fixed in a horizontal posture by the right slanting surface 28 as shown in the drawings. Numeral 30 designates a heater bar enclosing therein electric heating wires. This bar draws near the forward end of the folded insert 21 as the occasion demands.

One embodiment of the method of the present invention utilizes the table 20, the folding insert 21, the folding bar 22 and the heater bar 30. When the folding insert 21 moves away from the table 20, the jacket material 10 with the liner 11 thereon is fed from the front side of the table and the left end of the jacket material 10 is held by a stop pin (not shown in the drawings) so as to determine its position. Immediately after the jacket material is fed, the folding insert 21 is lowered and presses the left half portion 13 of the jacket material against the table. Then, the folding bar 22 approaches the table 20 and its front upper end surface B is moved against the underside of the forward end of the folding insert 21, whereupon the undersurface at the central part of the jacket material 10 is pressed against the projecting part of the folding insert 21 by the rotation of the folding bar 22 along locus A. At this time, the pivot 24 of the folding bar moves about 180° upwardly and rearwardly, along the arcuate locus A. At the initial stage of this movement of the folding bar, the end surface B of the folding bar moves rightwardly while rubbing the undersurface of the central part of the jacket material 10 and makes the central part of the jacket material 10 contact the projecting portion of the folding insert 21 tightly by the elastic force of the spring 25. When the folding bar moves back a little and the end surface B reaches the lower end of the projecting portion of the folding insert 21, the folding bar 22 rises while in a horizontal posture and the end surface B rubs the central portion of the jacket material 10 and bends the right half portion 12 90°. When the end surface of the folding bar reaches the upper end of the projecting portion of the folding inset 21, the folding bar turns with the end surface B as the center, in proportion to the movement of the pivot along the arcuate locus A, and advances leftwardly as it takes a reverse posture 22'.

By the reversal of the folding bar the right half portion of the jacket material is folded largely as shown by the chain line 12' and the folded corner is rubbed with the end surface B' and contacts the projecting portion of the folding insert 21 tightly. Before this time, namely, before the folding angle of the jacket material becomes 180°, the heater bar 30 advances and presses the folded corner of the jacket material against the forward end of the folding insert 21 to form the folded corner in a shape, as shown by the chain line 30'. The folding bar continues to advance and revolve as it is rubbing the jacket material with the end surface B" and when it revolved 180° as shown by the chain line 22", it presses the right half portion 12" of the jacket material against the upper surface of the folding insert 21. At this time, formation of the jacket material by heating has already finished and the heater bar 30 is retracted, the folding bar 22" is retracted to its original position and the table is revolved 90° so as to be shifted to the flap folding position for carrying out the following process.

In the conventional method of folding jacket material, the forward end of the folding bar is positioned at the end surface of the table and the folding bar is simply moved in an arc and therefore loosening, warping, waving, swelling, etc. are liable to take place at the folded edge. As a heater bar is applied to such folded edge, formation of the folded corner is inaccurate, with the result of poor external shape and poor dimensional precision of the jacket.

In this embodiment, however, a forward end of the folding insert is caused to project from the front edge of the table and the jacket material 10 is folded 180° as it is being rubbed by the folding bar 22. Therefore, the jacket material is entirely free from such trouble at the folded edge as loosening, warping, waving and swelling which often take place in the conventional method of folding. Moreover, since the jacket material is rubbed by the folding bar while it is heated by a heater bar which is applied earlier, the folded edge can be formed exactly in a shape, with resultant production of jackets of high precision in external shape and dimensions.

The following apparatus is most suitable for carrying out the method of folding jacket material 180° while rubbing it. An embodiment of the apparatus is explained below with reference to FIGS. 4–6.

In the drawings, numeral 20 designates a table of jacket forming device. A forward end of the folding insert 21 is caused to project slightly from the front edge of the table, the jacket material 10 with a liner adhered thereto is supplied onto the table and the left half portion 13 of the jacket material is pressed against the table by the folding insert 21. Numeral 22 designates a folding bar. Three bosses 23 provided at both ends and at the central part of the folding bar and the bar is loosely fitted to the pivot 24, around which springs 25 are wound with one end inserted in one of the collars 26 and the other end imparting to the folding bar 22 counterclockwise revolving force. The collar 26 has slant surfaces 27, 28 at right and left of its upper portion and the folding bar 22 is allowed some "play" of the angle by the slant surface 27 and is kept in a horizontal posture by the other slant surface 28. Numeral 30 is a heater bar, which is adapted to appraoch the projecting end of the folding insert 21. The above construction is as explained in the embodiment of the method according to the present invention.

Figure 4:
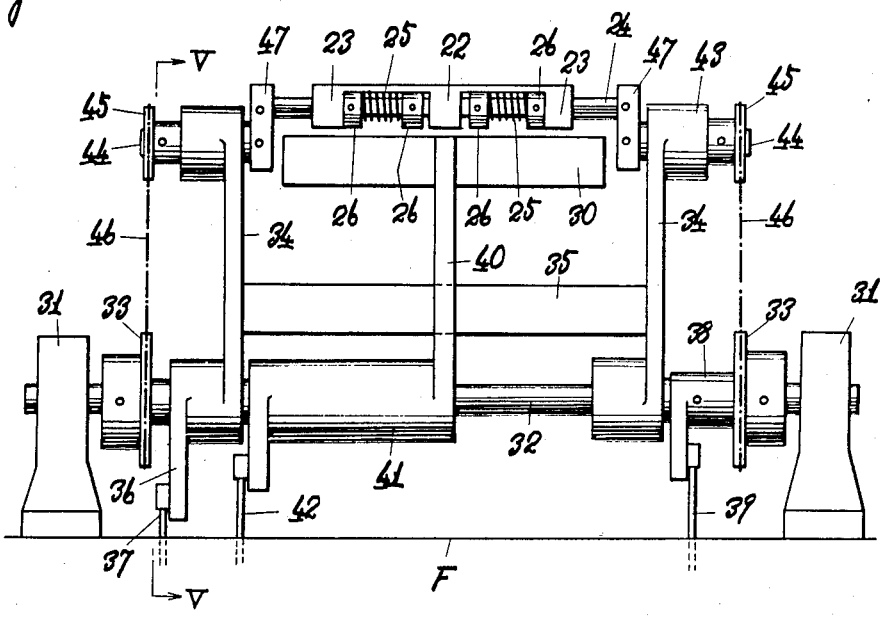
FIG. 4 is a front view showing one embodiment of an apparatus for carrying out the method according to the present invention.
Figure 5:
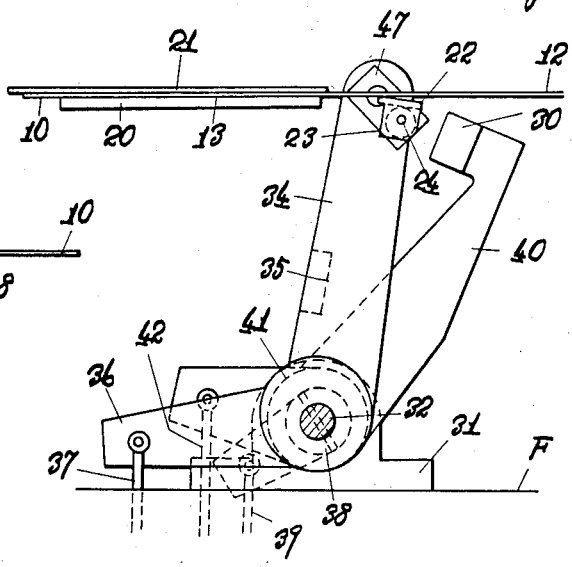
FIG. 5 is a cross section, taken along the line V—V in FIG. 4.

Numerals 31 designate are two bearings with some distance therebetween, which are fitted to a frame F located below the front edge of the table. A long lower axis 23 is inserted rotatably in this bearing. To both end portions of the lower axis 23, chain wheels 33 are fixed and bosses of arms 34 are fitted loosely. Two arms 34 are connected to each other by a stay 35. A link 37 is connected to a projecting portion 36 from the boss of one of the arms and another link 39 is connected to a projecting portion of a pipe 38 fixed to the lower shaft 32, adjoining the boss of the other arm. Numeral 40 designates a supporting rod interposed between arms 34. The central part of the heater bar 30 is fixed to the top end of the supporting rod and a cylindrical boss 41 provided at the lower end of the supporting rod is fitted loosely to the lower shaft 32. A link 42 is connected to a projecting portion from the boss 41. Numerals 43 designate bearings provided at the upper end of the arms 34, 34. Fixed to an outer end and an inner end of an upper shaft 44 loosely fitted in the bearings are a chain wheel 45 and a connecting piece 47 respectively. Chains 46 are put on these chain wheels 45 and chain wheels 33 on the lower shaft. The connecting pieces 47 are directed frontwardly and downwardly to connect both ends of the pivot 24. In order to facilitate understanding of the drawing, connecting pieces 47 in FIG. 4 are shown in their upper position.

Figure 6:
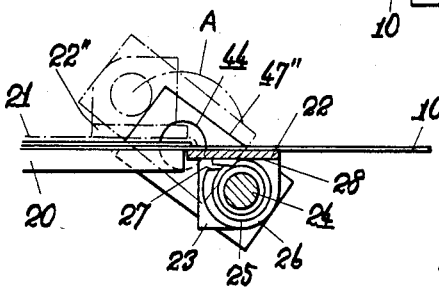
FIG. 6 is a cross section, on an enlarged scale, showing the operation of the folding bar.

An embodiment of the apparatus according to the present invention is constructed as described above. At first, the folding bar 22 and the heater bar 30 are standing by ready in the position shown in FIG. 5. When the jacket material 10 is fed to the upper surface of the table 20 and its left half portion 13 is pressed by the folding insert 21, the link 37 is lowered and arms 34, 34 are put in an upright position and as shown in FIG. 6, the folding bar 22 is caused to approach the table 20 and its front and upper end surface B is caused to engage the underside of the projecting end of the folding insert, whereupon the central part of the jacket material is pressed against the projecting portion of the folding bar. Then, the lower shaft 32 is revolved counterclockwise by lowering the link 39 and the upper shafts 44 are revolved by the two sets of chain wheels 33 and 45 and the chain 46, whereupon connecting pieces 47 fixed to the upper shaft revolve counterclockwise and move up from the frontward and downward posture, taking a rearward and upward posture as shown by the chain line 47″ in FIG. 6. Thus, the pivot 24 connected to the connecting piece moves along the arcuate locus A with the upper axis 44 as a center, as shown in FIG. 6. When the pivot 24 moves along the arcuate locus A, the folding bar 22 rises up after it retracts a little and then folds the jacket material 10 while rubbing the jacket material. The following reversal of the folding bar folds the jacket material 180°. Before the folding angle becomes 180°, the link 42 is lowered to make the arm 40 move so as to apply the heater bar 30 to the folded edge and to form it in a ⊐ shape. Then, the links 42, 39 and 37 are lowered to return the folding bar 22 and the heater bar to their respective original positions.

The foregoing are one embodiment of the method under the present invention and one embodiment of the apparatus for carrying out the method. This invention, however, is not limited to these embodiments and can be changed in design within the gist of the present invention. For example, the chain wheels 33 and 45 and the chain 46 may be replaced with gears and a timing belt. Also, links 37 and 42 and the link 39 to rock the lower axis 32 can be replaced with conventional advancing and retracting means and rocking means.

According to the method of the present invention, as the forward end of the folding insert is caused to project from the front edge of the table of the jacket forming device and the central part of the jacket material is folded 180° in tight contract with the folding insert while it is being rubbed by the folding bar, the folded edge is entirely free from loosening, warping, waving, swelling, etc. Moreover, as the jacket material is rubbed by the folding bar while it is being heated by the heater bar which is applied to the folded edge before the folding angle becomes 180°, the folded edge can be shaped in a ⊐ shape accurately, with resultant production of jackets with high precision in external shape and dimensions at high efficiency.

The apparatus for carrying out the method of the present invention is provided with the folding bar which folds jacket material 180° in tight contact with the folding insert as it is rubbing the jacket material, springs to impart revolving power to the folding bar and collars to maintain the folding bar in a horizontal posture, both of which are fitted to the pivot, chain wheels fixed to both end portions of the long lower shaft provided below the front edge of the table and bosses of two arms loosely fitted to the both end portions, bosses of the supporting rod fitted with the heater bar which are loosely fitted to the lower shaft, chain wheels fixed to the short upper shaft loosely fitted to the bearing at the upper end of the arm and chains between said chain wheels and chain wheels above the lower shaft, the pivot of the folding bar connected to the connecting piece fixed to the inner end of the upper shaft, means to advance and retract said arm and connecting rod and means to rock the lower axis. With this arrangement, the action of the folding bar to fold the central part of jacket material 180° while rubbing it and the action of applying the heater bar to the folded edge before the folding angle of the jacket material becomes 180° can be done smoothly by a simple structure.

What is claimed is:

1. A method of folding a flat plastic jacket material for forming an envelope for a magnetic disk or the like, the jacket material having a first side and a second side joined along a portion to be folded, said method comprising:

placing a first side of the jacket material on a folding table with said portion and the other side extending beyond the edge of the table;

placing a folding insert onto said first side with the forward end of the folding insert projecting past said edge of the table and pressing said one side against the table;

moving a folding bar upwardly from below the surface of the table against the projecting portion of the folding insert with the jacket material between the folding bar the folding insert and directly contacted by the folding bar;

moving the folding bar outwardly along the projecting portion of the folding insert while rubbing the jacket material against the folding insert and then moving the folding bar upwardly and back over the folding insert through an arc of substantially 180° to fold said portion of the jacket material around the end of the folding insert and fold the second side of the jacket material back against the top of the folding insert while continuing to rub the jacket material against the folding insert in tight contact therewith; and applying a heater bar directly against said portion of the jacket material where it extends over the end of the folding insert for shaping the end of the folding insert.

2. A method as claimed in claim 1 wherein the heater bar is applied to the folded portion before the second portion comes against the folding insert.

* * * * *